US005337124A

United States Patent [19]

Schmidlin et al.

[11] Patent Number: 5,337,124

[45] Date of Patent: Aug. 9, 1994

[54] LOW BEAD IMPULSE DONOR LOADING

[75] Inventors: Fred W. Schmidlin, Pittsford; Robert G. Martin, Irondequoit, both of N.Y.

[73] Assignee: Xerox Corporation, Stamford, Conn.

[21] Appl. No.: 952,082

[22] Filed: Sep. 28, 1992

[51] Int. Cl.[5] ..... G03G 15/06

[52] U.S. Cl. ..... 355/259; 118/653; 355/253

[58] Field of Search ..... 355/245, 251, 253, 259, 355/261, 264, 265, 270; 430/105, 122; 118/653, 657, 658

[56] References Cited

U.S. PATENT DOCUMENTS 4,385,829 5/1983 Nakahata et al. ..... 355/259 X
4,480,911 11/1984 Itaya et al. ..... 355/259 X
4,814,796 3/1989 Schmidlin ..... 346/155
4,982,690 1/1991 Funayama ..... 355/253 X
5,172,170 12/1992 Hays et al. ..... 355/259

FOREIGN PATENT DOCUMENTS 2186818 8/1987 United Kingdom ..... 355/253

*Primary Examiner*—Benjamin R. Fuller
*Assistant Examiner*—John E. Barlow, Jr.

[57] ABSTRACT

A toner delivery method and apparatus for delivering highly charged toner containing a minimum of wrong sign toner to a donor roll structure. The donor roll structure, in turn, delivers the toner to an image receiver or a DEP printhead structure. A magnetic brush is utilized for loading toner particles on the donor roll structure. A magnetic cleaning brush is provided for redistributing unused toner on the donor roll structure. The donor roll and magnetic brushes are positioned to form a cavity which is filled with developer material which prevents the formation of carrier bead chains.

7 Claims, 2 Drawing Sheets

LOW BEAD IMPULSE DONOR LOADING

BACKGROUND OF THE INVENTION

This invention relates generally to the rendering of latent electrostatic images visible. More particularly, the invention relates to delivering highly charged toner containing a low quantity of wrong sign toner to a donor roll structure.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction. In accordance with the present invention, a donor roll structure is utilized in the process of forming visible images.

The developed image is then fixed to the imaging surface or is transferred to a receiving substrate such as plain paper to which it is fixed by suitable fusing techniques.

Alternatively, the present invention can be utilized in a direct electric printer (DEP) system. In a DEP printer, a donor structure in the form of a roll is used to deliver toner particles to an apertured printhead through which toner particles are deposited in image configuration on plain paper. Apertures are selectively addressed in accordance with information to be printed.

U.S. Pat. No. 4,814,796 granted to Fred W. Schmidlin on Mar. 21, 1989 relates to a direct electrostatic printing apparatus including structure for delivering developer or toner particles to a printhead forming an integral part of the printing device. The printing device includes, in addition to the printhead, a conductive shoe which is suitably biased during a printing cycle to assist in the electrostatic attraction of developer through apertures in the printhead onto the copying medium disposed intermediate the printhead and the conductive shoe. The structure for delivering developer or toner is adapted to deliver toner containing a minimum quantity of wrong sign toner. To this end, the developer delivery system includes a conventional magnetic brush which delivers toner to a donor roll structure which, in turn, delivers toner to the vicinity of apertures in the printhead structure.

BRIEF SUMMARY OF THE INVENTION

In accordance with the present invention, a donor roll structure is loaded with toner particles using a magnetic brush which conveys two-component developer containing toner particles and carrier beads into a nip between the magnetic brush and the donor roll structure. The donor roll structure, magnetic brush and a roll for removing unused toner from the donor roll are positioned such that they form a cavity for maintaining a predetermined quantity of developer therein. By maintaining the cavity substantially full of developer, high velocity carrier bead impact with the donor roll structure is avoided thereby precluding impulsive transfer of unwanted (wrong sign) toner to the donor roll. Such transfer of unwanted toner to the donor roll would be caused by carrier beads striking the donor roll in a perpendicular direction. The filled cavity causes carrier beads to approach the donor roll along fluid flow lines which are strictly tangential to the donor roll prior to and in the loading nip between the donor roll and the magnetic brush and prior to and within the cleaning nip between the donor roll and the toner removal or cleaning roll. The filled cavity precludes a high normal component of carrier bead velocity as they approach the donor roll.

As will be appreciated the toner delivery apparatus can be used as a developer apparatus or as a toner donor in the case of DEP systems.

DETAILED DESCRIPTION OF THE PREFERRED EMBODIMENT OF THE INVENTION

Figure 1:
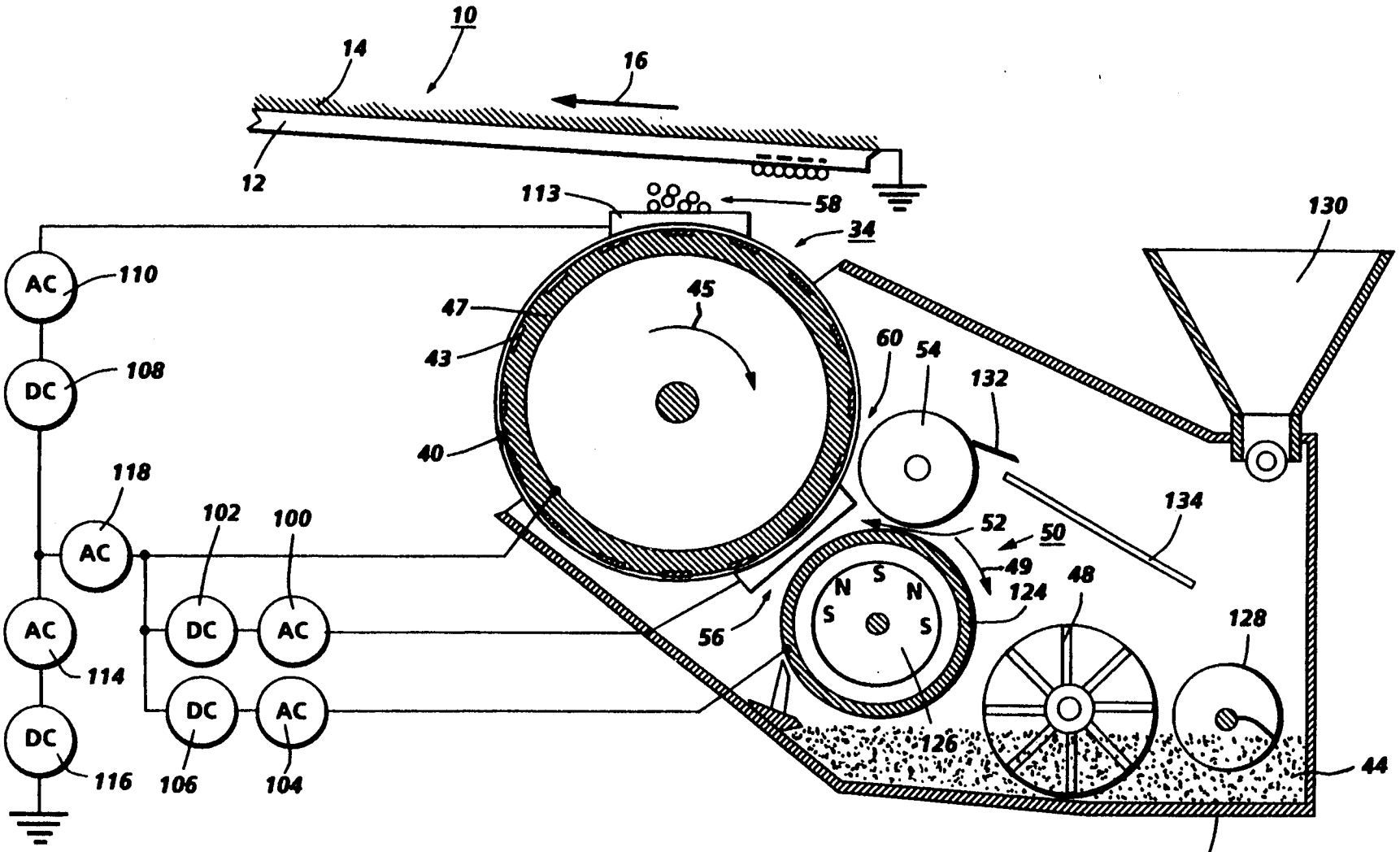
FIG. 1 is a schematic elevational view of a toner delivery apparatus according to the invention.
Figure 2:
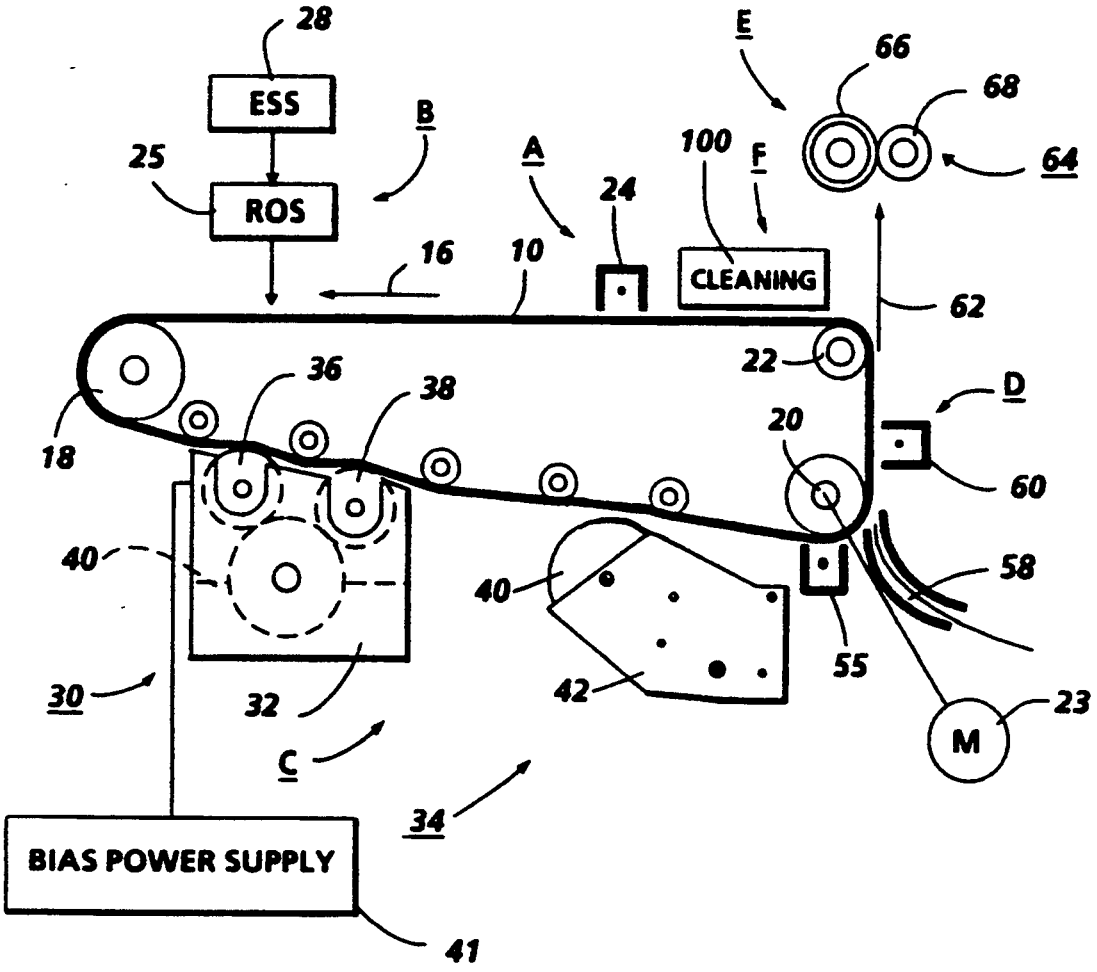
FIG. 2 is schematic illustration of a printing apparatus incorporating the inventive features of the invention

As shown in FIG. 2, a highlight color printing machine in which the invention may be utilized comprises a charge retentive member in the form of a photoconductive belt 10 consisting of a photoconductive surface 12 (FIG. 1) and an electrically conductive substrate 14 which is mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the roller 20 being used as a drive roller and the roller 18 being used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the uniformly charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 28 provides for control of the ROS as well as other subassemblies of the machine.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a development system, indicated generally by the reference numeral 30 advances developer material into contact with the electrostatic latent images. The development system 30 comprises first and second developer apparatuses 32 and 34. The developer apparatus 32 comprises a housing containing a pair of magnetic brush rollers 36 and 38. The rollers advance developer material 37 into contact with the latent images on the charge retentive surface which are at the voltage level $V_{ddp}$. The developer material 37 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 38 via the power supply 41. With the foregoing bias voltage applied and the color toner suitably charged, discharged area development (DAD) with colored toner is effected.

Preferably, developer unit 34 (FIG. 1) includes a donor roll or roller 40. Donor roller 40 is mounted, at least partially, in a housing 42. The housing 42 contains a supply of developer material 44. The developer material is a two-component developer comprising carrier beads or granules having toner particles adhering triboelectrically thereto. Developer material is transported to the donor roll structure via a paddle wheel 48 and loading brush 50. The brush 50 comprises a conventional magnetic brush structure suitable for transporting two-component developer. Any suitable paddle wheel structure suitable for transporting developer mix to the cavity 52 may be employed. The loading brush conveys the developer material into cavity 52 which is delineated by the donor roll 40, magnetic loading brush 50 and a scavenging or cleaning brush 54. The cleaning brush, like the loading brush, is also of magnetic construction, During operation, the loading brush 50 transports sufficient developer material 44 into the cavity 52 to maintain the cavity full of developer material. This prevents high velocity carrier bead impact with the donor roll structure thereby precluding impulsive transfer of unwanted (wrong sign) toner to the donor roll. In other words, the full condition of the cavity prevents extended bead bristles normally associated with a magnetic brush from forming prior to entering the development or loading nip. Movement of two-component developer through a nip 56 between the donor roll 40 and the loading brush 50 serves to deposit toner on the donor roll which is then transported to a development nip 58 between the donor roll and the photoreceptor belt 10.

In a cleaning nip 60, the gap between the cleaning brush and the donor and the magnetic properties of the brush are designed to scavenge and redistribute any unused toner that is returned from the development nip. An electrical bias to assist removal of wrong sign toner is avoided in the cleaning nip because it would favor the deposition of wrong sign toner on the donor roll before it moves into the development nip.

A pretransfer corotron 55 serves to convert the different polarity toners to the same polarity prior to transfer.

With continued reference to FIG. 2, after the electrostatic latent image is developed, belt 10 advances the toner powder image to transfer station D. A copy sheet 57 is advanced to transfer station D by sheet feeding apparatus, not shown. Preferably, sheet feeding apparatus includes a feed roll contacting the uppermost sheet of a stack of sheets. The feed roll rotates to advance the uppermost sheet from stack into chute 58. Chute 58 directs the advancing sheet of support material into contact with photoconductive surface of belt 10 in a timed sequence so that the toner powder image developed thereon contacts the advancing sheet at transfer station D. Transfer station D includes a corona generating device 61 which sprays ions onto the back side of sheet 57. This attracts the toner powder image from photoconductive surface 10 to sheet 57. After transfer, sheet 57 continues to move in the direction of arrow 62 onto a conveyor (not shown) which advances sheet 57 to fusing station E.

Fusing station E includes a fuser assembly, indicated generally by the reference numeral 64, which permanently affixes the transferred powder image to sheet 57. Fuser assembly 64 includes a heated fuser roller 66 and back-up roller 68. Sheet 57 passes between fuser roller 66 and backup roller 68 with the toner powder image contacting fuser roller 66. In this manner, the toner powder image is permanently affixed to sheet 57. After fusing, sheet 57 advances through a chute, not shown, to catch tray, also not shown, for subsequent removal from the printing machine by the operator.

After the copy sheet is separated from photoconductive surface of belt 10, the residual toner particles adhering to photoconductive surface of belt 10 are removed therefrom at cleaning station F. Cleaning station F may include a rotatably mounted fibrous brush, not shown, in contact with photoconductive surface 12. The fibrous brush is contained in a cleaning structure 100. The particles are cleaned from photoconductive surface 12 by the rotation of the brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the toner delivery apparatus of the present invention therein.

Reference is again made to FIG. 1, where the developer unit 34 is shown in detail for description of the electrical biasing of the rolls and brushes. Donor roll 40 is provided with conductors 43 positioned about the peripheral circumferential surface thereof. The electrical conductors are substantially equally spaced from one another and insulated from the body 47 of donor roll 40 which is electrically conductive. Donor roll 40 rotates in the direction of arrow 45. It should be appreciated that while the donor roll 40 and photoconductor 10 are shown moving in the "against" mode the "with" mode is also contemplated.

An alternating voltage source 100 and a constant voltage source 102 electrically bias the electrodes 43 via a brush 103 in the nip 56 between the donor roll 40 and the magnetic brush loading roller 50. This arrangement of electrical biases provides efficient toner loading and reloading of toner on the donor roll 40. The strong fringe electric fields associated with these voltages provide additional electrostatic forces in the toner reload zone. The magnetic brush 50 is electrically biased via AC voltage source 104 and DC voltage source 106. The relative voltages between donor roll 40 and magnetic roller 50 are selected to provide efficient loading of toner on donor roll 40 from the carrier granules adhering to magnetic roller 50. In certain instances, it may be desirable to use only DC bias voltages for toner loading.

In a development zone 58, an DC voltage source 108 and a AC voltage source 110 electrically bias isolated electrical conductors 43. As donor roll 40 rotates in the direction of arrow 45, successive electrodes 43 advance into the development zone 58. As shown in FIG. 1, a wiping commutator in the form of a brush 113 simultaneously contacts the electrodes 43 in development zone 58 and is electrically connected to voltage sources 108 and 110. In this way, an AC voltage is applied between the isolated electrical conductors and the donor roll for effecting detachment of toner from the donor roll yielding a toner powder cloud. In general, the DC voltage 108 can be set at an optimum bias that will depend upon the toner charge, but usually this voltage is set at zero.

The metal core 47 is biased by voltage sources 114, 116 and 118. DC voltage source 116 controls the DC electric field between the electroded donor roll assembly and photoconductive belt 10 for the purpose of suppressing background deposition of toner particles. The AC voltage 114 applied to the core 47 serves to establish an AC electrostatic field between the electroded donor roll and the image receiver or photoconductive belt 10. For a particular toner and gap setting between the donor and receiver, the amplitude and frequency can be selected to position the toner cloud in close proximity to the receiver to enable the development of an electrostatic image consisting of fine lines and dots. Furthermore, under these conditions, one can obtain scavengeless or non-interactive development for single-pass color system concepts.

AC voltage source 118 also applies an AC voltage to the core 47 of donor roll 40 for the purpose of applying an AC electrostatic field between the core of the donor roll and conductors 43, as well as between the donor roll and photoconductive belt 10. Although either of the AC voltages 118 and 110 could be zero, one of the voltages must not be zero so that a toner cloud can be formed in the development zone. For a particular toner and gap in the development zone between the donor roll and photoconductive belt, the amplitude and frequency of the AC voltage being applied on donor roll 40 by AC voltage supplies 110, 114 and 118 can be selected to position the toner powder cloud in close proximity to the photoconductive surface of belt 10, thereby enabling development of an electrostatic latent image consisting of fine lines and dots.

The wiping brush 103 engages donor roll 40 in loading zone 56. This insures that the donor roll is appropriately electrically biased relative to the electrical bias applied to the magnetic roller 50 in loading zone 56 so as to attract toner particles from the carrier granules on the surface of magnetic roller 50.

Magnetic roller 50 includes a non-magnetic tubular member 124 made preferably from aluminum and having the exterior circumferential surface thereof roughened. An elongated magnet 126 is positioned interiorly of and spaced from the tubular member. The magnet is stationarily mounted. The tubular member rotates in the direction of arrow 49 to advance the developer material adhering thereto into the loading zone 56. In loading zone 56, toner particles are attracted from the carrier granules on the magnetic roller to the donor roller.

Auger 128 is mounted rotatably in housing 42 to mix toner supplied via a toner supply hopper 130 and transport developer material. The augers have blades extending spirally outwardly from a shaft. The blades are designed to advance the developer material in the direction substantially parallel to the longitudinal axis of the shaft.

As successive electrostatic latent images are developed, the toner particles within the developer material are depleted. The toner supply hopper or dispenser 130 stores a supply of toner particles. The toner dispenser is in communication with the interior of the housing 42. As the concentration of toner particles in the developer material is decreased, fresh toner particles are furnished to the developer material in the chamber from the toner dispenser. The auger in the housing mixes the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferro-magnetic core having a thin layer of magnetite overcoated with a non-continuous layer of resinous material. The toner particles are made from a resinous material, such as a vinyl polymer mixed with a coloring material, such as chromogen black. The developer material comprises from about 95% to about 99% by weight of carrier and from 5% to about 1% by weight of toner. However, one skilled in the art will recognize that any other suitable developer material may be used.

A scraper blade 132 is provided for assisting the extraction and flow of carrier beads back to the bottom of the housing 42 in the area of the auger 128. A partition 134 serves to direct the beads removed by the blade to the auger.

What is claimed is:

1. Toner delivery apparatus for delivering toner particles to a development zone, said apparatus comprising:

a supply of developer material comprising toner and carrier particles;

a toner donor member for delivering toner to a development zone;

magnetic brush means for loading toner particles on said donor member, said developer material being conveyed from the supply thereof to a loading zone intermediate said donor member and said magnetic brush means, and means for scavenging unused toner on said donor member, said donor member, loading means and said scavenging means being positioned adjacent said development zone to form a cavity therebetween and adjacent said development zone for maintaining a predetermined quantity of developer whereby high velocity carrier bead impact with the donor member is avoided; and means for preventing formation of extended carrier bead chains in a nip in said loading zone.

2. Apparatus according to claim 1 wherein said scavenging means comprises a magnetic brush.

3. Apparatus according to claim 2 wherein said donor member comprises a donor roll structure.

4. Apparatus according to claim 3 including electrical biases for said donor member and said loading means for assisting loading of toner particles onto said donor roll and for depositing toner particles onto an image receiver.

5. A method for delivering toner particles to a development zone, said method including the steps of:

using a toner donor member, delivering toner to a development zone;

using loading means, loading toner particles on said donor member, said step of using loading means comprising using a magnetic brush for conveying developer material including toner and extended carrier from a supply thereof to a loading zone intermediate said donor member and said magnetic brush;

preventing formation of carrier bead chains prior to entering a nip in said loading zone using magnetic brush means for scavenging unused toner on said donor member; and positioning said donor member, loading means and said scavenging means to form a cavity therebetween and adjacent said development zone for maintaining a predetermined quantity of developer whereby high velocity carrier bead impact with the donor member is avoided.

6. The method according to claim 5 wherein step of using a toner donor comprises using a donor roll structure.

7. The method according to claim 6 including the steps of electrically biasing said donor roll structure and said loading brush for assisting loading of toner particles onto said donor roll structure and for depositing toner particles onto an image receiver.

* * * * *